US006964232B2

(12) United States Patent
Eberhart et al.

(10) Patent No.: US 6,964,232 B2
(45) Date of Patent: Nov. 15, 2005

(54) BULLET WITH SPHERICAL NOSE PORTION

(75) Inventors: Gerald T. Eberhart, Bethalto, IL (US); Richard A. Hayes, Brighton, IL (US)

(73) Assignee: Olin Corporation, East Alton, IL (US)

( * ) Notice: Subject to any disclaimer, the term of this patent is extended or adjusted under 35 U.S.C. 154(b) by 0 days.

(21) Appl. No.: 10/872,221

(22) Filed: Jun. 18, 2004

(65) Prior Publication Data

US 2005/0066844 A1 Mar. 31, 2005

Related U.S. Application Data

(62) Division of application No. 10/288,889, filed on Nov. 6, 2002, now Pat. No. 6,837,165.
(60) Provisional application No. 60/338,134, filed on Nov. 9, 2001.

(51) Int. Cl.[7] ..... F42B 30/00
(52) U.S. Cl. ..... 102/439
(58) Field of Search ..... 102/439, 507–510, 102/514

(56) References Cited

U.S. PATENT DOCUMENTS

| | | | |
|---|---|---|---|
| 911,591 A | 2/1902 | Hoxie | 102/570 |
| 843,017 A | 2/1907 | Hoxie | |
| 854,923 A | 5/1907 | Broad | 102/508 |

(Continued)

FOREIGN PATENT DOCUMENTS

| | | | |
|---|---|---|---|
| DE | 2843167 | 4/1980 | 102/510 |
| DE | 3840165 | 7/1990 | 102/510 |
| EP | 0385095 A1 | 1/1990 | F42B/8/14 |

(Continued)

OTHER PUBLICATIONS

May 2001—Cor–Bon Bullet Co. Press Release—"Cor–Bon is proud to announce a new line of premium high velocity ammunition loaded with the new PowRball™ bullet."
Aug. 2001—Nosler—"CT Ballistic Silvertip."
Aug. 2001—Nosler—Nosler Partition–HG.
Jun. 2001—Fangschuss—Expanding Full Metal Jacket (EFMJ) by Burczynski at pages 7 of 15 through 9 of 15.

* cited by examiner

*Primary Examiner*—Harvey E. Behrend

(74) *Attorney, Agent, or Firm*—Wiggin and Dana LLP; Gregory S. Rosenblatt; Elizabeth A. Galletta

(57) ABSTRACT

A bullet includes a frontward facing aperture. Contained within the aperture is a relatively hard bullet frontal element that provides advantageous bullet impact performance. In one embodiment, the frontal element is a steel sphere that provides advantageous penetration and weight retention when the bullet impacts laminated glass, such as an automobile windshield.

8 Claims, 11 Drawing Sheets

U.S. PATENT DOCUMENTS

| | | | | | |
|---|---|---|---|---|---|
| 896,021 | A | | 8/1908 | Hoxie | |
| 914,992 | A | | 3/1909 | Taylor | 102/510 |
| 1,004,510 | A | | 9/1911 | Watson | 102/508 |
| 1,135,357 | A | | 4/1915 | Clyne | 102/508 |
| 1,155,901 | A | | 10/1915 | Duncan | 102/508 |
| 1,322,662 | A | | 11/1919 | Watson | 102/510 |
| 1,493,614 | A | | 5/1924 | Dickerman | 102/510 |
| 2,336,143 | A | | 12/1943 | Werme | 102/514 |
| 2,414,863 | A | | 1/1947 | Foster | 102/517 |
| 3,069,748 | A | | 12/1962 | Nosler | 29/1.23 |
| 3,165,809 | A | | 1/1965 | Burns, Jr. et al. | 29/1.23 |
| 3,311,962 | A | | 4/1967 | Burns, Jr. | 29/1.23 |
| 3,485,173 | A | | 12/1969 | Morgan | 102/92.2 |
| 3,791,301 | A | * | 2/1974 | La Costa | 102/45 |
| 3,866,536 | A | | 2/1975 | Greenberg | 102/91 |
| 3,935,816 | A | * | 2/1976 | Boquette, Jr. | 102/41 |
| 4,044,685 | A | | 8/1977 | Avoin | 102/508 |
| 4,136,616 | A | | 1/1979 | Schirneker, III | 102/510 |
| 4,175,492 | A | | 11/1979 | Knappworst et al. | 102/517 |
| 4,245,557 | A | | 1/1981 | Knappworst et al. | 102/91 |
| 4,655,140 | A | | 4/1987 | Schirneker, I | 102/508 |
| 4,685,397 | A | | 8/1987 | Schirneker, ii | 102/510 |
| 4,770,098 | A | * | 9/1988 | Stoner | 102/434 |
| 4,793,037 | A | | 12/1988 | Carter | 29/1.23 |
| 4,879,953 | A | | 11/1989 | Carter | 102/507 |
| 4,958,568 | A | * | 9/1990 | Buenemann | 102/466 |
| 5,079,814 | A | | 1/1992 | Moore et al. | 29/1.2 |
| 5,149,913 | A | | 9/1992 | Arakaki | 102/517 |
| 5,150,909 | A | | 9/1992 | Fitzwater | 102/522 |
| 5,160,805 | A | | 11/1992 | Winter | 102/507 |
| 5,404,815 | A | | 4/1995 | Reed | 102/507 |
| 5,535,678 | A | * | 7/1996 | Brown | 102/439 |
| 5,621,186 | A | | 4/1997 | Carter | |
| 5,760,329 | A | | 6/1998 | Baum et al. | 102/439 |
| 5,804,759 | A | | 9/1998 | Sauvestre | 102/439 |
| 5,811,723 | A | | 9/1998 | Stone | 102/509 |
| 5,943,749 | A | | 8/1999 | Swank | 29/1.22 |
| 6,105,506 | A | | 8/2000 | Gangale | 102/509 |
| 6,115,894 | A | | 9/2000 | Huffman | 29/1.22 |
| 6,148,731 | A | | 11/2000 | Winter | 102/509 |
| 6,176,186 | B1 | | 1/2001 | Engel | 102/510 |
| 6,293,203 | B1 | * | 9/2001 | Alexander et al. | 102/430 |
| 6,532,876 | B1 | * | 3/2003 | Ramirez et al. | 102/439 |
| 6,779,461 | B1 | * | 8/2004 | Olson et al. | 102/439 |

FOREIGN PATENT DOCUMENTS

| | | | | |
|---|---|---|---|---|
| EP | 0563552 | A1 | 2/1993 | F42B/5/02 |
| EP | 0636853 | A1 | 12/1993 | F42B/12/34 |
| GB | 690460 | | 4/1953 | 102/507 |
| RU | 02117909 | C1 | 8/1998 | F42B/30/02 |
| RU | 2138008 | C1 | 9/1999 | F42B/30/02 |
| WO | 9425818 | | 11/1994 | 102/509 |
| WO | WO01/67030 | A1 | 2/2001 | |
| WO | WO01/88460 | A1 | 11/2001 | F42B/12/34 |
| WO | WO02/054007 | A1 | 7/2002 | F42B/7/10 |

BULLET WITH SPHERICAL NOSE PORTION

CROSS-REFERENCE TO RELATED APPLICATION

This Patent Application is a divisional of U.S. patent application Ser. No. 10/288,889 entitled "BULLET WITH SPHERICAL NOSE PORTION," that was filed on Nov. 6, 2002 U.S. Pat. No. 6,837,165, and relates to and claims priority to U.S. Provisional Patent Application Ser. No. 60/338,134 entitled "BULLET," that was filed on Nov. 9, 2001. The disclosure of Provisional Patent Application Ser. No. 60/338,134, and patent application Ser. No. 10/288,889, are incorporated by reference in their entireties.

BACKGROUND OF THE INVENTION (1) Field of the Invention

This invention relates to small arms ammunition, and more particularly to bullets particularly useful in common calibers of centerfire pistol and revolver (collectively "pistol") ammunition.

(2) Description of the Related Art

A variety of cartridge sizes exist which may be used in pistols, rifles or both. Common pistol ammunition rounds include: .380 Automatic (also commonly designated 9 mm Kurz), 9 mm Luger (also commonly designated 9×19 and 9 mm Parabellum), .40 Smith & Wesson (S&W), 45 Automatic (also commonly designated Automatic Colt Pistol (ACP)) and 10 mm Automatic rounds. General dimensions of pistol rounds are disclosed in *Voluntary Industry Performance Standards for Pressure and Velocity of Centerfire Pistol and Revolver Ammunition for the Use of Commercial Manufacturers* ANSI/SAAMI Z299.3-1993 (American National Standards Institute, New York, N.Y.), the disclosure of which is incorporated by reference herein as if set forth at length.

A newer round, the .357 Sig is also gaining acceptance.

After many decades of use of the .45 ACP round, in the 1980's the US Army adopted a 9 mm Luger full ogival, pointed, full metal case or jacket (FMC or FMJ) round as the standard round for use in military sidearms. The parameters for the M882 9 mm Luger rounds purchased by the US military are shown in United States Military standard MIL-C-70508, the disclosure of which is incorporated by reference in its entirety herein as if set forth at length.

Historically, pistol bullets have been of all lead or of jacketed lead constructions. More recent developments include various dual-core bullets and monoblock bullets. Key examples of the former are Nosler Partition® bullets (trademark of Nosler, Inc. of Bend, Oreg.). The Nosler Partition-HG™ bullet is a handgun hunting bullet formed by impact extruding a brass body with a transverse web separating front and rear compartments and then installing lead cores in such compartments. Examples of the monoblock bullets are found in U.S. Pat. Nos. 5,760,329 and 6,148,731 and EP0636853.

It is common practice today in the United States and Europe to evaluate a projectile's performance against various barriers using gelatin as a simulant for tissue. Particularly in law enforcement cartridges, projectiles are tested against a ballistic gelatin block to determine a projectile's ability to provide adequate penetration and incapacitate a threat. In the United States projectiles are commonly evaluated against bare gelatin, heavily clothed gelatin, and gelatin covered with four layers of denim. One series of test events disposes a sheet of steel, wallboard, plywood, and/or auto glass as a barrier ahead of the gelatin block. Specific exemplary test events utilized to evaluate projectile performance are:

Test Event 1: Bare Gelatin

The gelatin block is bare, and shot at a range of ten feet (3.0 m) measured from the muzzle to the front of the block.

Test Event 2: Heavy Cloth

The gelatin block is covered with four layers of clothing: one layer of cotton T-shirt material (48 threads per inch (18.9 threads/cm)); one layer of cotton shirt material (80 threads per inch (31.5 threads/cm)); a ten-ounce down comforter in a cambric shell cover (232 threads per inch (91.3 threads/cm)); and one layer of thirteen-ounce cotton denim (50 threads per inch (19.7 threads/cm)). The block is shot at ten feet (3.0 m) measured from the muzzle to the front of the block.

Test Event 3: Four Layers of Denim

The gelatin block is covered with four layers of denim material (thirteen-ounce cotton denim –50 threads per inch (19.7 threads/cm)). The block is shot at ten feet (3.0 m) measured from the muzzle to the front of the block.

Test Event 4: Steel

Two pieces of 20 gage (1 mm (equivalent to 0.0396 inch)thick ) by six-inch (15 cm) square hot rolled steel with a galvanized finish are set three inches (7.6 cm) apart. The gelatin block is covered with light clothing and placed eighteen inches (45.7 cm) behind the rearmost piece of steel. The shot is made at ten feet (45.7 cm) measured from the muzzle to the front of the steel. Light clothing is one layer of the above described cotton T-shirt material and one layer of the above described cotton shirt material, and is used as indicated in all subsequent test events.

Test Event 5: Wallboard

Two pieces of half-inch (1.27 cm) thick, six-inch (15.2 cm) square standard gypsum board are set 3.5 inches (8.9 cm) apart. The gelatin block is covered with light clothing and set eighteen inches (45.7 cm) behind the rear most piece of gypsum. The shot is made at ten feet (3 m) measured from the muzzle to the front surface of the first piece of gypsum.

Test Event 6: Plywood

One piece of three-quarter inch (1.91 cm) thick, six-inch (15.2 cm) square AA fir plywood is used. The gelatin block is covered with a light clothing and set eighteen inches (45.7 cm) behind the rear surface of the plywood. The shot is made at ten feet (3 m) measured from the muzzle to the front surface of the plywood.

Test Event 7: Automobile Glass

One piece of A.S.I. (American Standards Institute) one-quarter inch laminated automobile safety glass measuring 15×18 inches (38.1×45.7 cm) is set at an angle of 45 degrees to the horizontal. The line of bore of the weapon is offset 15 degrees to the side, resulting in a compound angle of impact for the bullet upon the glass. The gelatin block is covered with light clothing and set eighteen inches (45.7 cm) behind the glass. The shot is made at ten feet (3 m) measured from the muzzle to the center of the glass pane.

Test Event 8: Heavy Cloth at 20 Yards (18.3 m)

This event repeats Test Event 2 but at a range of 20 yards (18.3 m) measured from the muzzle to the front of the block.

Test Event 9: Automobile Glass at 20 Yards (18.3 m)

This event repeats Test Event 7 but at a range of 20 yards (18.3 m) measured from the muzzle to the front of the glass. The shot is made from straight in front of the glass without the 15 degrees of offset.

These test events were developed to duplicate what are considered to be field scenarios commonly encountered in law enforcement. For testing purposes, generally five shots are fired in each test event. For each shot, penetration is measured and recorded. The projectile is then recovered from the gelatin block, weighed, measured for expanded diameter, and information recorded. It is desirable for a projectile to retain a high percentage of original bullet weight to promote at least a certain amount (e.g., twelve inches (30.5 cm)) of penetration to reach what is considered to be the vital areas of a target. It is also desirable for a projectile to yield adequate expansion and not allow penetration greater than a greater amount (e.g., eighteen inches (45.7 cm)) to reduce the risk of collateral damage. Results of various bullet configurations are then compared for optimum performance.

Of the test events listed, auto glass probably presents the most challenge in developing a bullet that will retain a high percentage of original bullet weight and yield adequate penetration while still providing consistent, reliable performance in the other test events/encounters. Bullets penetrating auto glass are subjected to very high abrasive and cutting forces imparted directly to the bullet exterior (e.g., to the jacket of a jacketed bullet). These forces act in conjunction to literally cut and strip the bullet jacket from the core material. It is common for the jackets of conventional jacketed projectiles to separate from the core material during penetration of auto glass, jacketed hollow point (JHP) and FMJ styles alike. It is very difficult to produce JHP bullets that perform well in all of the test events described.

Environmental legislation and regulations in the United States have increased in recent years, initiating development of lead-free, nontoxic, bullets for training purposes. These bullets are typically of a FMJ or soft point configuration. Although toxicity has been more of a concern in the area of training ammunition, future regulations may dictate the development of lead-free, nontoxic, duty rounds for law enforcement in the United States. This is already a reality in Europe where lead-free monoblock bullets such as those shown in U.S. Pat. No. 5,760,329 and EP 0636853 have entered service.

BRIEF SUMMARY OF THE INVENTION

We have developed a number of bullets and manufacturing techniques through which the bullets may be made. We have sought to produce bullets that will retain a high percentage of retained weight after penetrating auto glass and still yield outstanding performance in other test events. Key implementations utilize a frontal element formed as a steel sphere crimped into a nose cavity to improve the retained weight in impacts against auto glass. Advantageously, the sphere will also aid bullet expansion in tissue or tissue simulant. Examples include bullets resembling thick walled versions of Partition® rear core bullets (trademark of Nosler, Inc. of Bend, Oreg.), monoblock bullets, and JHP bullets.

An advantageous manufacturing technique is a multi-stage impact extrusion process forming a brass bullet body. In a final manufacturing stage, the sphere may be placed in a finishing die and supported by an ejection pin. The body is then inserted and depressed to inwardly crimp the body nose around the sphere.

A jacket notching technique may be employed to assist with improving the expansion characteristics of this bullet. Notching the bullet jacket facilitates petal formation during expansion that adds to the consistency and reliability of the bullet in a wide variety of test barriers excluding auto glass. An exemplary notching technique involves a combination of cutting and scoring to pre-fail the jacket material. Cutting of the jacket material completely through at the mouth of the jacket improves expansion at lower velocities. This is advantageous because barriers reduce the impact velocities of projectiles prior to entering tissue or tissue simulant. The scoring of the jacket material is a continuation of the cut on the interior wall of the jacket. The scoring angle (e.g., the angle between the centerline of the jacket and the cut) is established in combination with the jacket wall profile at whatever angle is necessary to provide a "trail" for the petals to follow during expansion. By properly adjusting the metal thickness at the bearing surface/ogive intersection and properly running the scoring to this intersection, strong petals may be created that resist fragmentation at higher velocity levels.

Preferred bullet embodiments are formed substantially as drop-in replacements for existing pistol bullets.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

FIG. 7D' is an enlarged version of FIG. 7D showing exemplary dimensions in inches.

Like reference numbers and designations in the various drawings indicate like elements.

DETAILED DESCRIPTION

Figure 1:
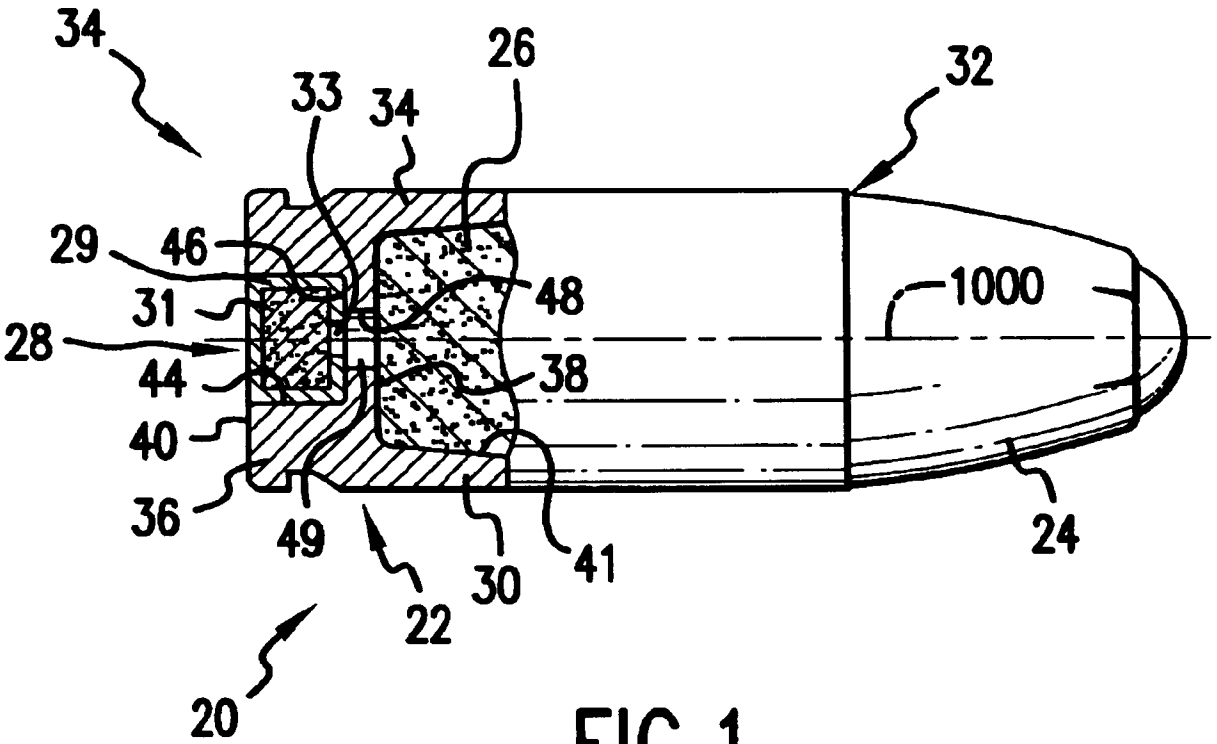
FIG. 1 is a partial cutaway view of a pistol cartridge.

FIG. 1 shows, a cartridge 20 including a case 22, a bullet 24, a propellant charge 26, and a primer 28. Preferably, the case and primer are of conventional dimensions and materials such as those of the M882 round. In the illustrated embodiment, the case is unitarily formed of brass and is symmetric about a central longitudinal axis 1000 it shares with the bullet. The case includes a wall 30 extending from a front (fore) end 32 to a rear (aft) end 34. At the rear end of the wall, the case includes a head 36. The head has front and rear surfaces 38 and 40, respectively. The front surface 38 and interior surface 41 of the wall 30, define a cavity configured to receive the propellant charge 26. The head has surfaces 44 and 46 defining an approximately cylindrical primer pocket extending forward from the rear surface 40. The head has a surface 48 defining a flash hole extending from the primer pocket to the cavity. In the illustrated embodiment, the surface 48 and flash hole 49 defined thereby are cylindrical, e.g., of uniform circular cross-section.

The primer 28 includes a metal cup 29, formed as the unitary combination of a sleeve portion and a web portion spanning the sleeve at a rear end of the sleeve. Preferably a nontoxic, lead-free (e.g., dinol-based) primer charge 31 is contained within the cup along a forward surface of the web. Forward of the primer charge, an anvil is disposed across the cup and has rear and forward surfaces and at least one venting aperture 33 (vent) extending between such surfaces. A paper disk or foil is disposed on the rear surface of the anvil.

Figure 2:
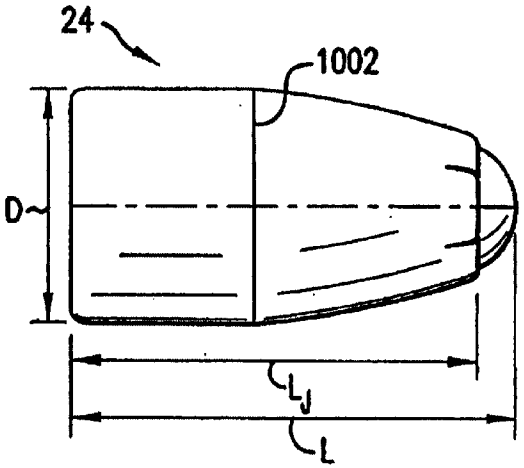
FIG. 2 is a side view of a bullet.

A first embodiment of a bullet 24 (FIGS. 2 & 3) consists essentially of a metallic jacket or body 60, a frontal element 62, and a rear core 64. The jacket 60 is advantageously formed from a copper alloy such as a brass as the unitary combination of: a sidewall 66 extending from a forward rim 68 to a rear rim 70 at an aft or rear end 72; and a central transverse web 74. The web separates front and rear compartments or nose and heel cavities within the bullet. The front and rear compartments are defined in major part by front and rear sidewall inner surfaces 76 and 77, respectively, along with front and rear surfaces 78 and 79 of the web. The exemplary bullet is shown as a secant ogive bullet having an overall length L and a jacket length $L_j$. The maximum diameter of the bullet is shown as D which is the diameter along the predominant rear portion of the bullet aft (rearward) of the border 1002 with the ogive.

The rear core 64 substantially fills the rear compartment and is held in place by a coning of the jacket adjacent the rear rim 70. In the exemplary embodiment, the rear core is formed of lead. A heel aperture 80 may, optionally, be enclosed by a sealing disc (not shown) which may advantageously help contain the lead for environmental reasons. The frontal element 62 is secured within a front portion of the front compartment and extends to a front end 81 of the bullet. In the exemplary embodiment, the frontal element is formed as a steel sphere having a diameter $D_s$ with a center located slightly aft of the rim 68. An empty space 82 is provided by a rear portion of the front compartment behind the frontal element. A plurality of notches 84 extend longitudinally along the inner surface 76 rear from the rim 68. The jacket or portion thereof (e.g., the outer surface 86) may, optionally, bear a coating, plating, or both.

Exemplary material for the rear core is lead or a lead-base alloy (e.g., an alloy including 2.5% antimony). "Base" means the alloy composition is more than 50% by weight of the specified component. In an exemplary 124-grain (8.04 g), 9 mm bullet, this lead rear core has a mass of 58.1 grains (3.76 g). This mass corresponds with a particularly common 9 mm FMC bullet. Other masses (e.g., 115-grain (7.45 g)) are also in common use and nontraditional masses may be appropriate depending upon the application. Alternate materials may be used. These may be used when low/non toxicity lead-free bullets are required. Exemplary materials include bismuth, a metal-filled polymer (e.g., tungsten-filled Nylon), and metal matrix composites (e.g., formed by various powder metallurgical or other techniques). The rear core serves principally to provide the bullet with mass and, need not necessarily be particularly ductile as would be associated with expansion of the core. Accordingly, there may be somewhat greater flexibility in choice of rear core materials than is typically present in high density materials used for deforming portions of projectiles.

Exemplary material for the frontal element is steel (e.g., 1008 steel having a nominal composition by weight of 0.3%–0.5% Mn, max. 0.1% C and the balance iron). The sphere 62 may be formed from cut wire as is conventional in the shot art. The frontal element serves multiple roles. As with existing monoblock bullets utilizing non-metallic spheres, autoloading is facilitated as is a degree of reduction in the tendency of the frontal compartment to plug when the bullet impacts soft barriers. Additionally, the hardness and toughness of the sphere along with its mass and positive engagement with the jacket, make the sphere a more active participant in penetrating harder barriers, such as thin steel and laminated glass (e.g., auto glass). The stiffness of the sphere, along with the contouring of the jacket also causes the sphere to serve as a wedge promoting expansion of the jacket during penetration into tissue or tissue simulant. In the exemplary 9 mm bullet, the frontal element has a diameter of 0.200 inch (0.508 cm) and a mass of 8.4 grains (0.54 g). A spherical frontal element is particularly advantageous from a cost point of view as steel spheres are commodity products in the shot and bearing industries and from a manufacturing ease point of view as is discussed below.

Exemplary hardness for the frontal element is approximately 100 DPH, consistent with steel shot commonly used in shotshells. A wide range of hardness may be acceptable. Steel spheres of hardness of 200 DPH or greater should function well and may be less expensive to procure. Hardness below 100 DPH may also be appropriate, particularly for metals other than steel. Hardness in excess of 80 would identify most likely steels whereas lower hardness (such as an excess of 160 DPH would comprehend a number of alternative alloys). "DPH" refers to Diamond Pyramid Hardness, a number related to an applied load and the surface area of a permanent impression made by a square faced pyramidal diamond inserter having included angle faces of 136°

$$DPH=1.8544P/d^2$$

Where P=applied load (kgf) and d is mean diagonal of the impression (mm).

Similarly, the specific gravity of steel is approximately 7.9, when measured at room temperature. A specific gravity in excess of approximately 5.0 would comprehend key alloys and composites of metals such as zinc, tin, and copper and a specific gravity in excess of 2.5 would comprehend most alloys of aluminum. Specific Gravity is the ratio of the density of a substance to the density of water at 4.0° C. which has a density of 1.00 kg/liter.

In the auto glass test event, the sphere is believed to improve retained weight by initiating and absorbing the initial impact forces imparted to the bullet by the quarter-inch high-temper laminated auto glass. The sphere is believed to initiate contact with the auto glass and begin pulverizing and crushing of the first outer pane or layer of glass. This is believed to significantly reduce the amount of abrasion or cutting forces that would otherwise be imparted directly to the bullet jacket itself without the sphere. The sphere is additionally believed to prevent the build up of the auto glass material inside the hollow point that typically assists in peeling the jacket material away from the core material in JHP bullets. It is believed that the jacket wall thickness/hardness in combination with the sphere provides the necessary bullet integrity to prevent core/jacket separation and retain a high percentage of original bullet weight in the auto glass test event.

Exemplary jacket material is Copper Development Association (CDA of New York, N.Y.) 210 brass (nominal composition by weight 95% copper and 5% zinc). In the exemplary 9 mm bullet, the diameter D is 0.355 inch (0.902 cm) and the lengths L and $L_j$ are 0.721 and 0.658 inch (1.83 and 1.67 cm). The exemplary jacket mass is 57.5 grains (3.73 g).

Figures 4A, 4B, 4C, 4D, 4E, 4F, 4G:
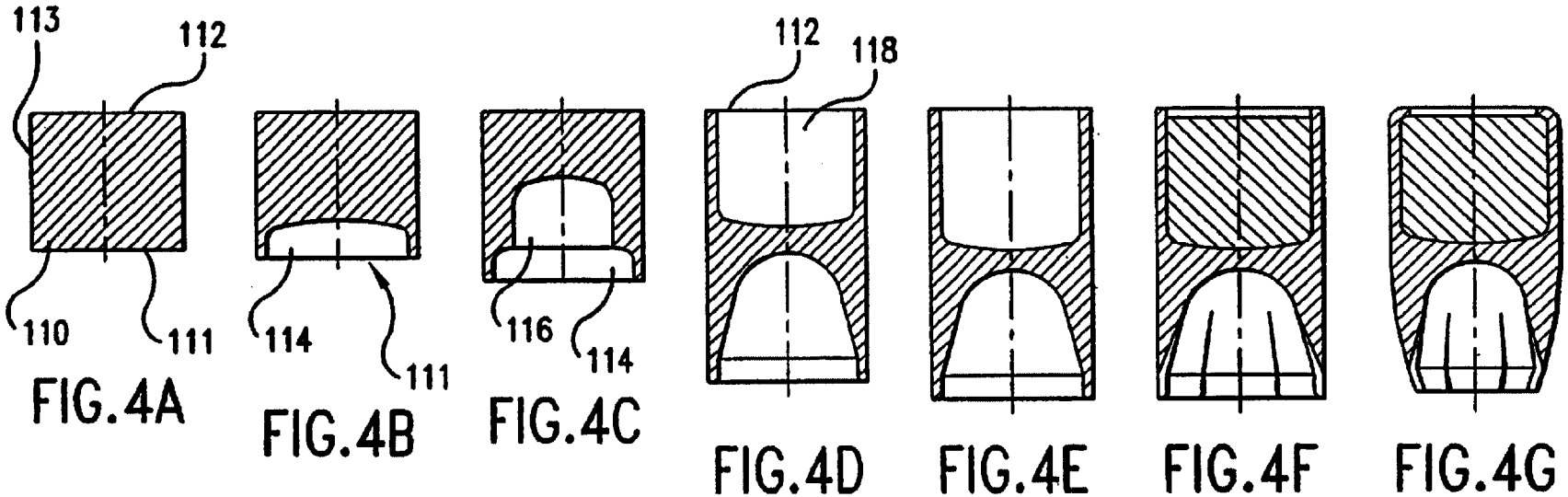
FIGS. 4A–4G are longitudinal sectional views showing stages in the manufacture of the bullet of FIG. 2.

With reference to FIGS. 4A–4G, a preferred method of manufacture is an impact extrusion process similar to that used the manufacture Partition® bullets. A jacket precursor slug 110 is first produced such as via cutting from wire or rod with a subsequent consolidation into a more exact shape (e.g., a cylinder) and an annealing process to soften the cylinder. The slug proceeds through a series of impact extrusion steps in one or more stations. The slug has front, rear, and lateral surfaces 111, 112, and 113, respectively. In the exemplary sequence of operations, the slug is oriented with its front surface facing downward. In a first operation (FIG. 4B) a first nose cavity precursor indentation 114 is punched via a first punch (not shown) in the front surface 111. In a second punching operation, a second indentation 116 (FIG. 4C) is punched via a second punch (not shown) so as to extend aft from a base of the first indentation 114. The second indentation 116 is of relatively smaller diameter and greater length than the first indentation 114 and, therefore, begins to form the jacket sidewall with a relatively greater thickness than at the indentation 114. In a subsequent operation, a third punch (not shown) forms a rear compartment indentation or precursor 118 in the rear surface 112 (FIG. 4D). Advantageously in the same punching operation, a fourth punch (not shown) cones the transition between the compartments 114 and 116 to form a smoother transition and a more consistently tapering sidewall thickness.

A jacket finish forming operation (FIG. 4E) is advantageously performed to produce a jacket with front and rear compartments of predetermined and consistent dimensions. In a closed system, both tools are shouldered to produce consistent cavities. Namely, the front and rear punches have annular shoulders positioned to engage front and rear rims of the deformed precursor so that resulting front and rear cavities have the precise complementary forms of the portion of the associated punch beyond the shoulder. This shouldering causes any excess material to preferentially form in the web where the effects of variations on bullet performance are relatively low. In a subsequent operation (FIG. 4F), the material for forming the rear core is introduced to the extended rear compartment indentation. If the nose is to be notched, the notches may be cut at this point via a punch or bottom pin (not shown). In a subsequent operation (FIG. 4G), the bullet heel is coned, turning a rear portion of the sidewall inward to initially lock the rear core material in the rear compartment. Additionally, the nose is initially broken down, pushing the forward extremity of the sidewall inward to begin contraction of the front compartment and form the bullet ogive.

Figure 5A:
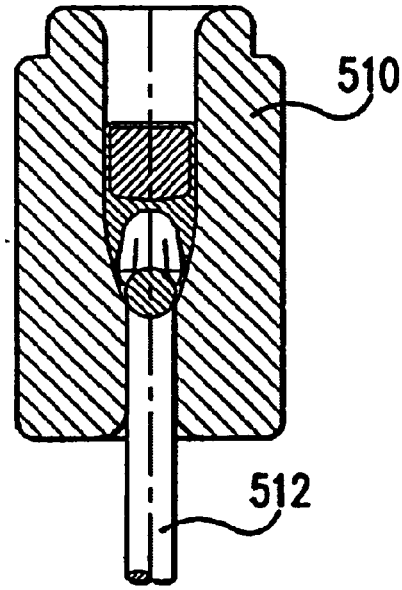
FIGS. 5A and 5B are longitudinal sectional views showing the effects of the manufacturing stage of FIG. 4H.
Figure 5B:
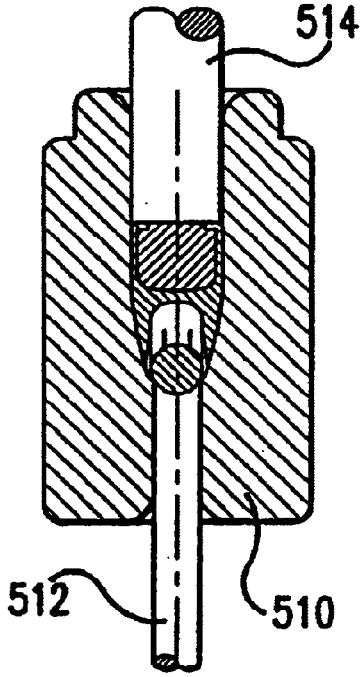

A subsequent bullet finish-forming operation (FIGS. 5A and 5B) finishes the inward crimping of the rear portion of the sidewall to finally secure the rear core material in the rear compartment and define the ultimate bullet heel. Additionally, the sphere is located partially within the front compartment and a frontal portion of the sidewall crimped around the sphere to lock the sphere securely in place and define a final ogival shape. In one advantageous implementation of this last step, the frontal element is dropped into a forming die 5 10 where it is at least partially supported by an ejection pin 512 at the bottom of the die. The jacket, already containing the material for the rear core, is then dropped nose-first into the die so that the forward rim of the jacket encircles a portion of the frontal element (FIG. 5A). A rear finishing punch 514 (FIG. 5B) is then inserted into the upper end of the die and contacts the bullet heel. The punch drives the jacket downward so that a sliding interaction of the jacket against the die crimps the frontal portion of the jacket inward against the frontal element. The pressure from the punch also finishes the heel. Afterward, the punch 514 is withdrawn and the finished bullet may be ejected via raising the ejection pin 512 to apply pressure to the frontal element sufficient to eject the bullet from the die. The pin 512 may then be withdrawn to its original location to finish the next bullet.

The jacket material properties, sidewall thickness along the rear compartment and the thickness of the web are selected to be sufficient to protect the rear core upon impact with hard targets, particularly auto glass and bone. The thickness along the front compartment is a profiled thickness that provides the appropriate qualities to obtain the desired expansion results. Specifically, the thickness profile is thin at the front and increases toward the web. The thinner wall thickness at the nose promotes expansion at lower velocities while the increased wall thickness ahead of the web helps to resist fragmentation at higher velocities. The location of the web and associated front compartment geometry is believed to control the expansion of the bullet and also absorb impact forces imparted by auto glass when obliquely impacted. In the auto glass test event, the angle of impact is such that the bullet makes contact with the auto glass over substantially the entire length of the bullet ogive. From the nose to the web, the bullet jacket is exposed to the abrasive/cutting forces created during penetration of the auto glass. Thickening the bullet jacket in this area relative to conventional JHP bullets improves bullet integrity to resist these abrasive/cutting forces from stripping the bullet jacket from the core material.

The method of manufacture of impact extruding the bullet jacket provides the appropriate thickness in the jacket wall profile required to successfully penetrate and retain the high percentage of original bullet weight in the auto glass test event. This is believed a particularly cost-efficient method of producing this bullet jacket.

Notching the front compartment improves the expansion characteristics of the bullet. Notching allows petal formation during expansion that adds to the consistency and reliability of the bullet in a wide variety of test barriers. The preferred notching technique involves a combination of cutting and scoring to pre-fail the jacket material. The cutting of the jacket material completely through at the mouth of the jacket allows for expansion at lower velocities. This is critical because barriers reduce the impact velocities of projectiles as they pass through the barrier prior entering tissue or tissue simulant. The scoring of the jacket material is a continuation of the cut on the interior wall of the jacket. The scoring angle is established in combination with the jacket wall profile at whatever angle is necessary to provide a "trail" for the petals to follow during expansion. By properly adjusting the metal thickness ahead of the web and properly extending the scoring to just ahead of the web location, strong petals are created that resist fragmentation at higher velocity levels.

In many jurisdictions (e.g., a number of European countries), it is regarded as undesirable for expanded bullets to form petals. In an unnotched jacket, use of the present frontal element in conjunction with the proper jacket wall thickness profile (e.g., a slight thinning) in the bullet nose may provide acceptable expansion to satisfy the needs of such jurisdictions.

Optionally, a core material can be placed in the front compartment in order to further increase bullet weight. There may advantageously be a space between the frontal element and such front core material and/or such core material may have a compartment (e.g., a hemispherical cylindrical, or conical shape) formed into it. It is believed advantageous that there be a sufficient gap between the two to permit an initial movement of the frontal element into contact with the core to enhance expansion upon impact with tissue or tissue simulant. Nevertheless, such a gap or the like may well be filled (for example with a relatively light and deformable polymer).

Figure 3:
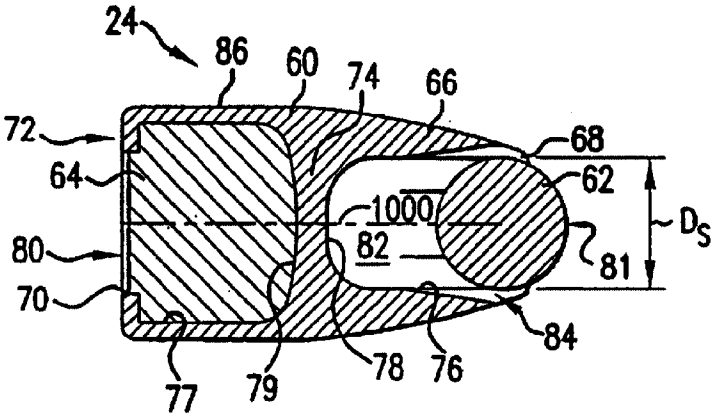
FIG. 3 is a longitudinal sectional view of the bullet of FIG. 2.

In a first example (Ex. 1), 9 mm bullets were prepared according to the exemplary embodiment of FIG. 3. The bullets were loaded and fired in gelatin testing with emphasis in the auto glass test event. Test results indicate an average retained weight of 90% or more in the auto glass test event and exceptional expansion and penetration results in bare, heavy cloth, and four layers of denim testing.

Figure 6:
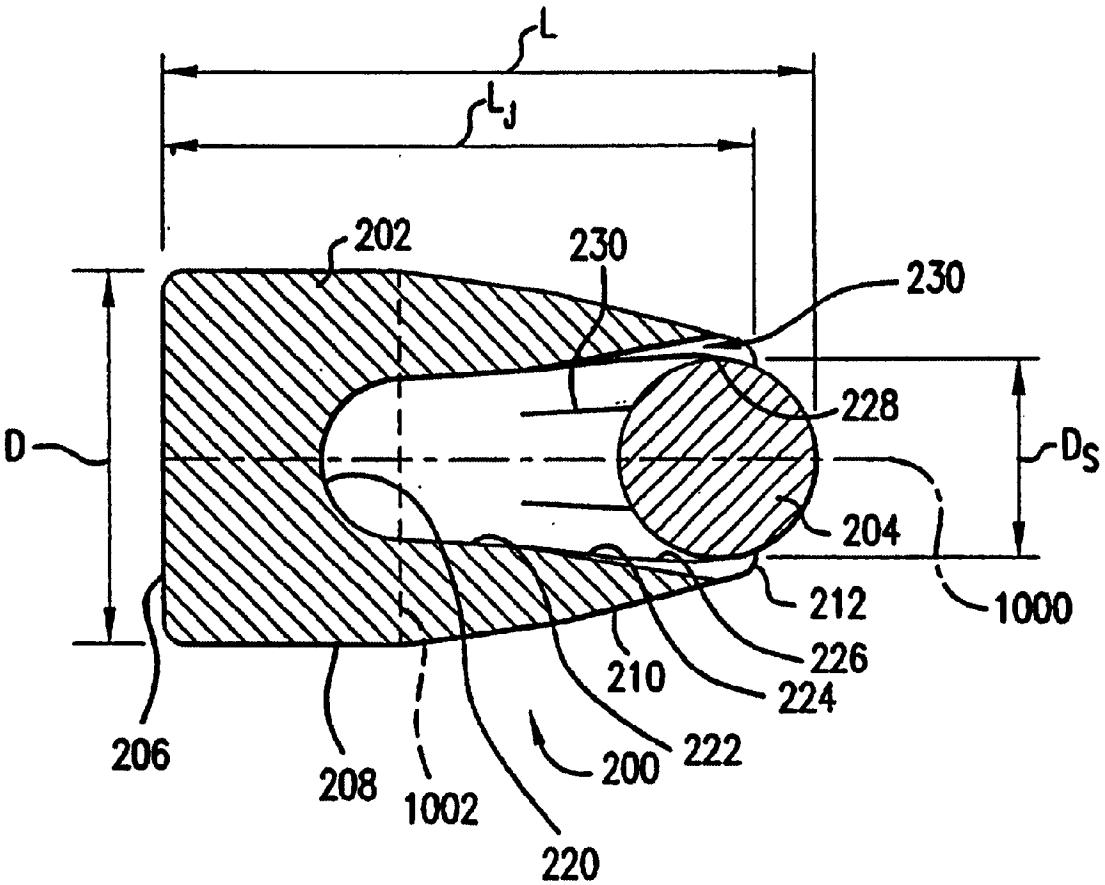
FIG. 6 is a longitudinal sectional view of a second bullet.

FIG. 6 shows an alternate bullet 200 consisting essentially of a body 202 and a frontal element 204 and resembling more of a conventional monoblock bullet. As is discussed below, the body 202 is advantageously manufactured via a process similar to that described for the jacket 60 and may be formed from similar materials and having similar geometry (e.g., of the front compartment and bullet ogive). The frontal element 204 may be similar to the frontal element 62 in both structure and function.

In an exemplary implementation, the body lacks a rear compartment and has a relatively long frontal compartment. The outer surface of the exemplary secant ogive body has a generally flat heel 206 at a rear end, radially transitioning to a generally cylindrical rear portion 208 which in turn meets the ogive surface 210 at a circular border 1002. The ogive transitions to a forward rim 212. The exemplary forward compartment has a near hemispherical rear surface 220 which transitions to a slightly forwardly opening or diverging surface portion 222. In the exemplary embodiment, this transition is longitudinally near the border 1002. The surface portion 222 meets a slightly more divergent surface portion 224. A surface portion 226 extends forward from the portion 224 at slightly less than that of an angle the axis 1000. A surface portion 228 extends forward from the surface portion 226 and is at least partially forwardly convergent to retain the frontal element in the frontal compartment. In the illustrated embodiment, longitudinal notches 230 extend aft from the rim 212. Internally, the exemplary notches extend aft to near the transition between the surface portions 222 and 224. Externally, the exemplary notches extend a much shorter distance (e.g., just slightly behind the center of the frontal element).

In an exemplary 9 mm embodiment, the frontal element 204 is formed as a steel sphere of diameter $D_s$ of 0.190 inch (0.4483 cm) having a mass of 7.2 grains (0.47 g). The absence of a lead rear core allows the frontal compartment to be relatively deep (e.g., a depth slightly more than twice the frontal core diameter. Upon impact, the frontal element is driven rearward in the jacket. Its engagement with the surface portions 224 and 222, along with dynamic factors, enhance petalling. As this occurs, the surface portion 222 widens from an initial diameter somewhat less than that of the frontal element, ultimately leaving the frontal element trapped at or near the rear surface portion 220. Relative to a shorter, broader compartment this is believed to achieve enhanced petalling and enhanced retention of the frontal element. Retention of the frontal element can be particularly desirable in certain police uses to allow the bullet to be removed as a unit from flesh into which it has been shot.

Figure 7A:
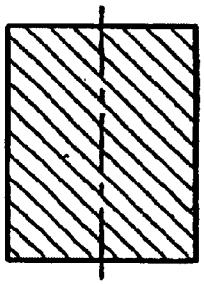
FIGS. 7A–7G are longitudinal sectional views showing stages in the manufacture of the bullet of FIG. 6.
Figure 7B:
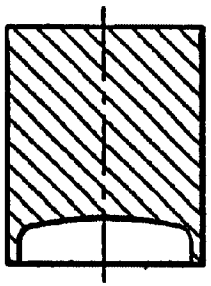
Figure 7C:
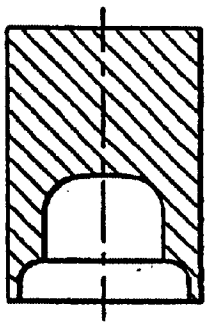
Figure 7E:
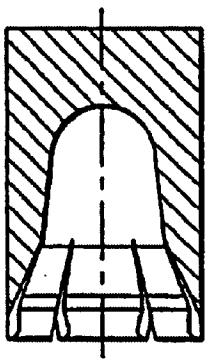
Figure 7F:
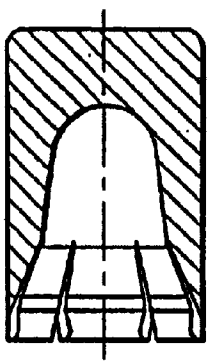
Figure 7G:
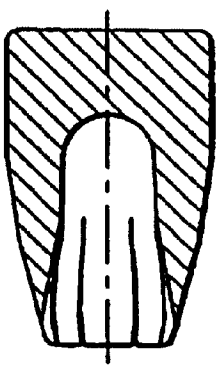
Figure 7D:
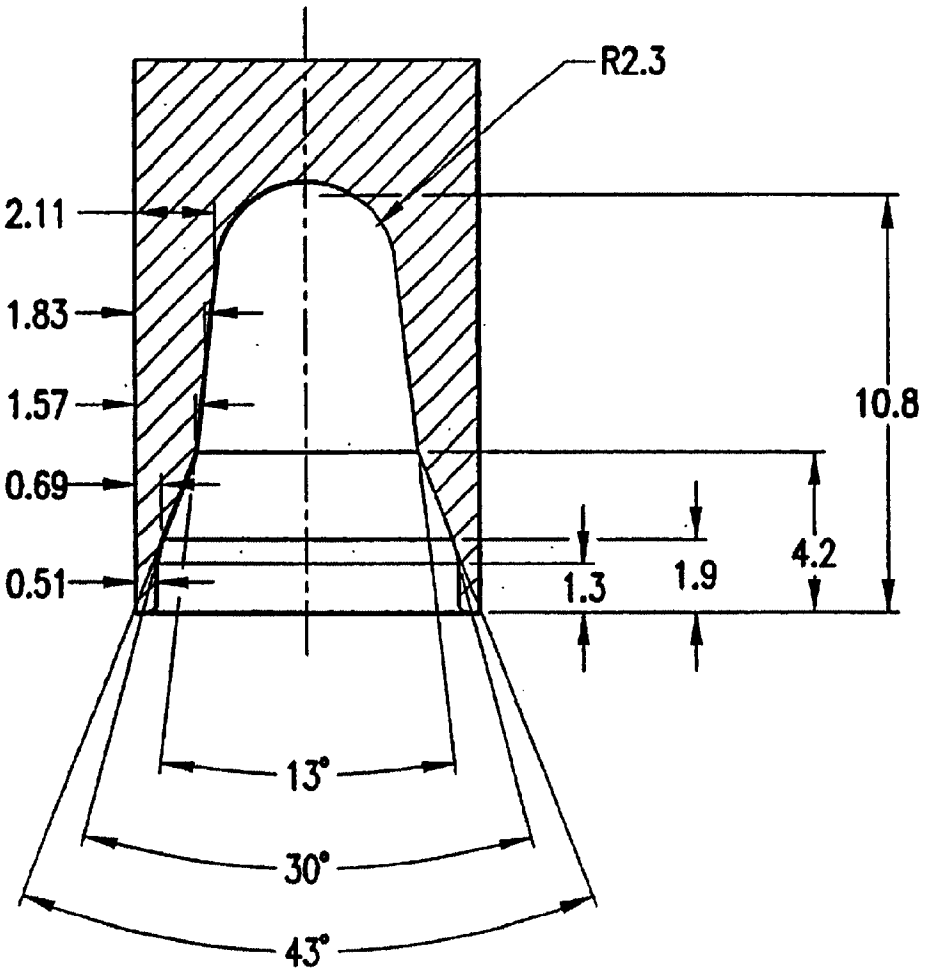

An exemplary series of manufacturing stages for the bullet 200 is shown in FIGS. 7A–7G These show notching which is optional. In some markets, an unnotched version of this bullet might be preferred for regulatory reasons. These may be generally similar to corresponding manufacturing stages for the bullet 24. FIG. 7D shows exemplary dimensions (in millimeters unless otherwise identified) for a precursor of the frontal compartment of the bullet.

As with existing monoblock bullets, machining of the bullet jacket from rod stock is also a possibility but may be more expensive than the impact extrusion process.

An exemplary 9 mm embodiment has a mass of 90 grains (5.83 g) and an overall length of 0.605 inch (1.54 cm).

In a second example (Ex. 2), 9 mm, 90 grain (5.83 g) monoblock bullets were formed as shown in FIG. 6 except for the absence of notching. The bullets were loaded and fired in gelatin testing with emphasis on the auto glass test event. Test results indicate an average retained weight of 90% or more in the auto glass test event and exceptional expansion and penetration results in bare, heavy cloth, and four layers of denim testing. These bullets are considered to have performed exceptionally well.

Figure 8:
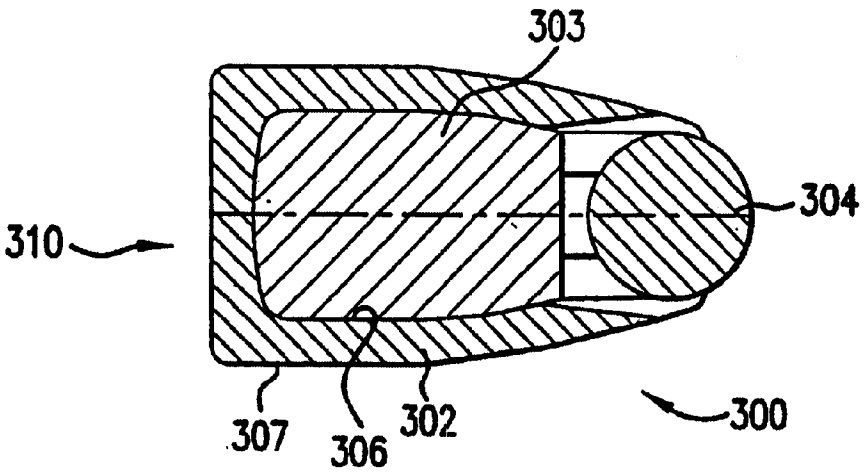
FIG. 8 is a longitudinal sectional view of a third bullet.
Figures 9A, 9B, 9C, 9D, 9E, 9F, 9G, 9H:
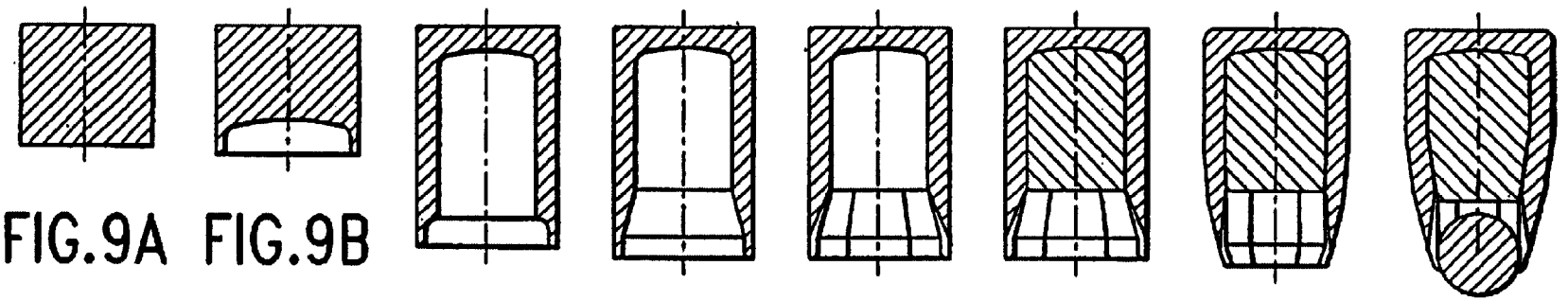
FIGS. 9A–9H are longitudinal sectional views showing stages in the manufacture of the bullet of FIG. 8.

FIG. 8 shows an alternate bullet 300 consisting essentially of a jacket or body 302, a core 303, and a frontal element 304. As is discussed below, the jacket 302 is advantageously manufactured via an impact extrusion process similar to that described for the bodies 60 and 202 and may be formed from similar materials and having similar geometry. The frontal element 304 may be similar to the elements 62 and 204 in both structure and function.

The illustrated jacket 302 is formed with a single compartment extending aft from the front rim. The compartment is relatively longer than that of the body 202 with the extra length being sufficient to contain the core 303. As with the core 64, the core 303 is advantageously formed of lead, a lead alloy, or an appropriate heavy lead substitute. The amount of the compartment occupied by the core may vary based upon a number of design considerations. In the illustrated embodiment of FIG. 8, the lead core occupies sufficient volume of the compartment to leave less empty space aft of the frontal element than in the bullets 60 and 200. In such a situation, the deformability of the core material may be of greater concern than in the bullet 60.

An exemplary series of manufacturing operations for the bullet 300 is shown in FIGS. 9A–9H.

An exemplary 9 mm embodiment has a mass of 124 grains (8.03 g). The exemplary jacket, core, and frontal element masses are 81.6, 34.0, and 8.4 grains (5.29, 2.20, and 0.54 g), respectively. The overall bullet length is 0.720 inch (1.83 cm). Compared to conventional jacketed hollow point bullets utilizing drawn jackets, the jacket 302 has substantially greater thickness than the conventional drawn jacket. In the exemplary embodiment, the thickness between inner and outer surfaces 306 and 307 is generally fairly constant along the side wall aft of the tapered area approximate the nose and a generally similar thickness is present at the heel 310. This thickness is in the vicinity of 0.050 inch (1.3 mm). In this particular embodiment, this thickness is advantageously at least 1.0 mm. This general thickness may extend along a portion of at least about 5.0 mm and preferably closer to 10 mm aft of the tapered area. As noted above, along the ogive, the thickness may be generally similar to that of the bodies of the bullets 24 and 200 to provide a similar combination of low velocity expansion and high velocity fragmentation resistance.

In a third example (Ex. 3), 9 mm bullets were formed as in the exemplary embodiment of FIG. 8. The bullets were loaded and fired in gelatin testing with emphasis in the auto glass test event. Test results indicate an average retained weight of 90% or more in the auto glass test event and exceptional expansion and penetration results in bare, heavy cloth, and four layers of denim testing. These bullets are considered to have performed exceptionally well. It is worthwhile noting that this amount of retained weight is exceptional in comparison to standard conventional jacketed hollow point bullets. In a variation on the bullet 300, the jacket sidewall may be extruded with a reverse taper along a portion thereof (e.g., along a rear portion of the sidewall, the thickness decreases). This may further enhance the locking of the jacket to the core.

Figure 10:
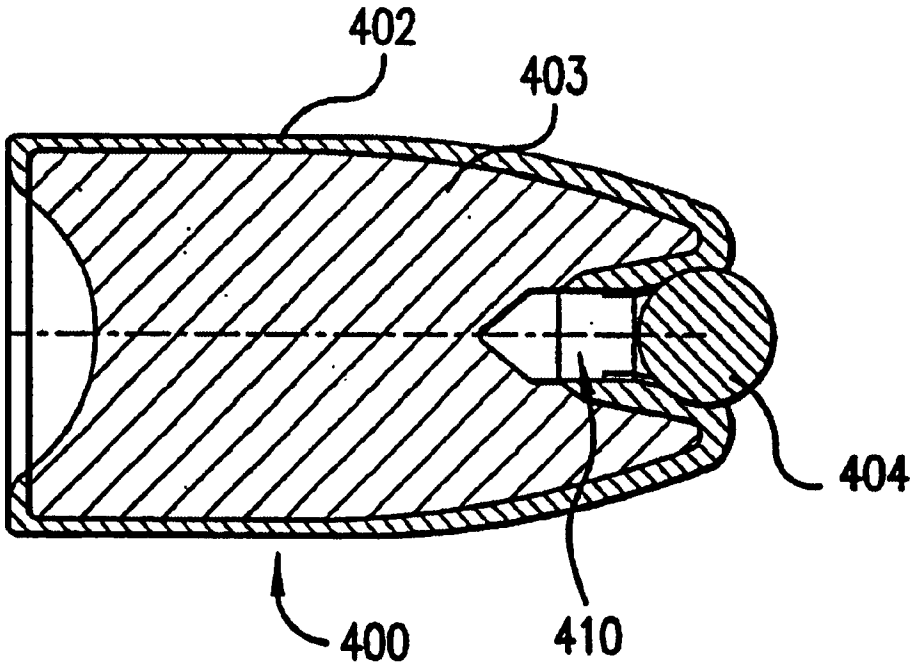
FIG. 10 is a longitudinal sectional view of a fourth bullet.

FIG. 10 shows an alternate bullet 400 consisting essentially of a jacket 402, a core 403, and a frontal element 404. The bullet 400 may be formed by adding the frontal element to the configuration of an existing hollowpoint bullet such as the Winchester Ranger 'T' Series™ bullet (Winchester Division of Olin Corporation, East Alton, Ill.). In such a bullet, the jacket is turned inward at the nose to form a substantial portion of the lateral boundary of the front compartment 410. This jacket configuration may constrain the front compartment to be of somewhat smaller diameter than with other combinations, and, therefore, require a corresponding reduction in the size of the frontal element. An exemplary 9 mm embodiment has a mass of 124 grains (8.03 g). An exemplary jacket, core, and frontal element masses are 61.6, 54.0, and 8.4 grains (3.99, 3.50, and 0.54 g), respectively. The overall bullet length is 0.680 inch (1.73 cm). Due, e.g., to manufacturing, aerodynamics, and dimensional concerns, the frontal element may well be substantially smaller (e.g., in the vicinity of two grains (0.13 g)). Such a relatively small frontal element may play little role in enhanced feeding and may principally serve to enhance impact performance. Similar considerations may be present for bullets in traditional rifle calibers.

Figure 11A:
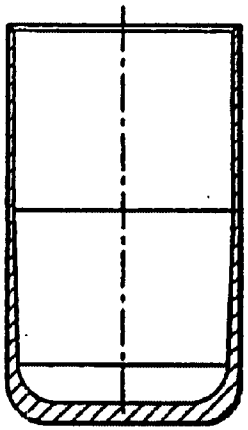
FIGS. 11A–11E are longitudinal sectional views showing stages in the manufacture of the bullet of FIG. 10.
Figure 11B:
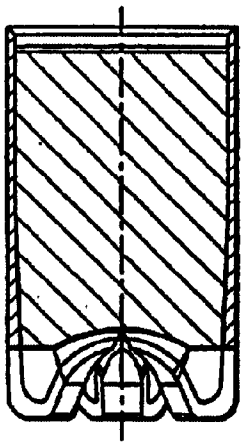
Figure 11C:
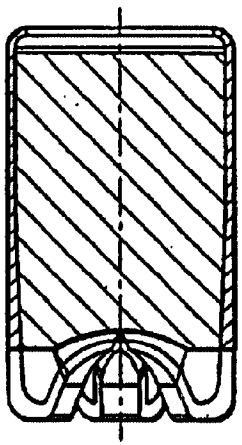
Figure 11D:
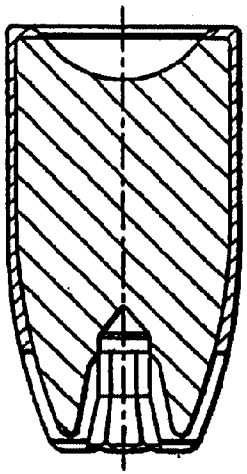
Figure 11E:
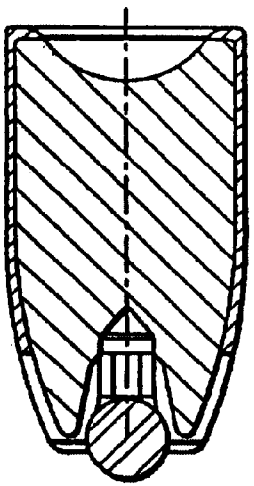

An exemplary series of manufacturing operations for the bullet 400 are shown in FIGS. 11A–11E. A brass cup jacket precursor is formed (FIG. 11A) and inserted into an assembly press. A lead core is inserted and seated into the cup and the press impresses a nose cavity precursor and notches the jacket along such cavity precursor (FIG. 11B). The rim of the jacket is initially deformed inwardly to commence heel formation (FIG. 11C). The basic bullet is finish formed in a profiled die, with the core pressed forward to fill the jacket surrounding the nose cavity and provided a rear convexity (FIG. 11D). The frontal element is then inserted in the bottom of a final insertion die and the jacket and core assembly driven down into the die to crimp the frontal element partially within a forward portion of the front compartment (FIG. 11E).

One or more embodiments of the present invention have been described. Nevertheless, it will be understood that various modifications may be made without departing from the spirit and scope of the invention. For example, the bullet may be tailored for particular applications and for particular calibers (including rifle calibers and sabot bullets for shotguns) and loads in view of any applicable regulations regarding materials, performance and the like. Accordingly, other embodiments are within the scope of the following claims.

What is claimed is:

1. A bullet comprising:

a body having a generally cylindrical rear portion and an ogival front portion that terminates at a forward rim, said ogival front portion having a coaxial front compartment extending inwardly from said forward rim and terminating at a near hemispherical rear surface and having a continually forwardly diverging surface portion that terminates at a forwardly convergent portion that engages a frontal element; and said frontal element extending partially into said front compartment and protruding from the front compartment, said frontal element having a specific gravity of at least 2.5 and a hardness in excess of 60 DPH, in combination with:

a case of a dimension effective to support a bullet having a caliber selected from the group consisting of .357, .38, .40, .44, .45, 9 mm, and 10 mm, the bullet being accommodated by a mouth of the case;

a propellant charge within the case; and a primer held by the case so as to form a cartridge.

2. An ammunition cartridge, comprising:

a case of a dimension effective to support a bullet having a caliber selected from the group consisting of .357, .40, .45, 9 mm and 10 mm;

a bullet secured partially within a mouth of the case and comprising:

a copper alloy body having a forwardly open compartment with a wall thickness of at least 1.0 mm along a portion of at least 5.0 mm; and a steel insert partially protruding from the compartment;

a propellant charge within the case; and a primer held within a head of the case.

3. The ammunition cartridge of claim 2 wherein the bullet includes at least one core having a density greater than a density of the body and wherein the insert is not in contact with any such core.

4. The bullet of claim 1 wherein the primer includes a metal cup formed as a combination of a sleeve portion and a web portion wherein said web portion spanning said sleeve at a rear end of said sleeve.

5. The bullet of claim 4 wherein the metal cup contains a nontoxic, lead-free, primer charge.

6. The ammunition cartridge of claim 2 wherein the primer includes a metal cup formed as a combination of a sleeve portion and a web portion wherein said web portion spanning said sleeve at the rear end of said sleeve.

7. The ammunition cartridge of claim 6 wherein the metal cup contains a nontoxic, lead-free, primer charge.

8. The ammunition cartridge of claim 3 wherein the core is formed of lead.

* * * * *